United States Patent [19]

Colley

[11] Patent Number: 5,025,913

[45] Date of Patent: Jun. 25, 1991

[54] ARTICLE CONVEYING DEVICE

[75] Inventor: Robert G. Colley, Arnold, England

[73] Assignee: Imperial Tobacco Limited, Hartcliffe, England

[21] Appl. No.: 437,377

[22] Filed: Nov. 16, 1989

[30] Foreign Application Priority Data

Nov. 16, 1988 [GB] United Kingdom ..... 8826777

[51] Int. Cl.[5] ..... B65G 47/19

[52] U.S. Cl. ..... 198/550.01; 198/533; 222/245

[58] Field of Search ..... 198/533, 347.1, 772, 198/550.01; 222/547, 245; 414/525.9, 288, 325

[56] References Cited

U.S. PATENT DOCUMENTS

| | | | |
|---|---|---|---|
| 2,540,670 | 2/1951 | Hoenecke | 198/772 X |
| 2,562,614 | 7/1951 | Howe | 222/245 |
| 3,366,223 | 1/1968 | Haen | 198/772 X |
| 3,403,773 | 10/1968 | Loesch et al. | 198/772 X |
| 3,443,547 | 5/1969 | Ferris et al. | 198/772 X |
| 3,605,699 | 3/1970 | Ferris et al. | 198/772 X |
| 4,082,178 | 4/1978 | Van Nocker | 198/772 X |
| 4,149,547 | 4/1979 | Komossa et al. | 198/533 X |
| 4,790,333 | 12/1988 | Focke et al. | 198/347.1 X |
| 4,923,356 | 5/1990 | Foster | 414/525.9 X |

*Primary Examiner*—David A. Bucci
*Attorney, Agent, or Firm*—Larson & Taylor

[57] ABSTRACT

A conveying device is provided in a chamber (16) for conveying articles from an inlet (15) to an outlet (20). The device comprises a base support (53) upon which articles rest and an inclined side support (54). Both supports (53, 54) are movable relative to end walls (42, 43) of the chamber (16) and relative to each other to move articles towards the outlet (20) and then to create a void adjacent the inlet (15).

13 Claims, 3 Drawing Sheets

FIG. 3(iii)
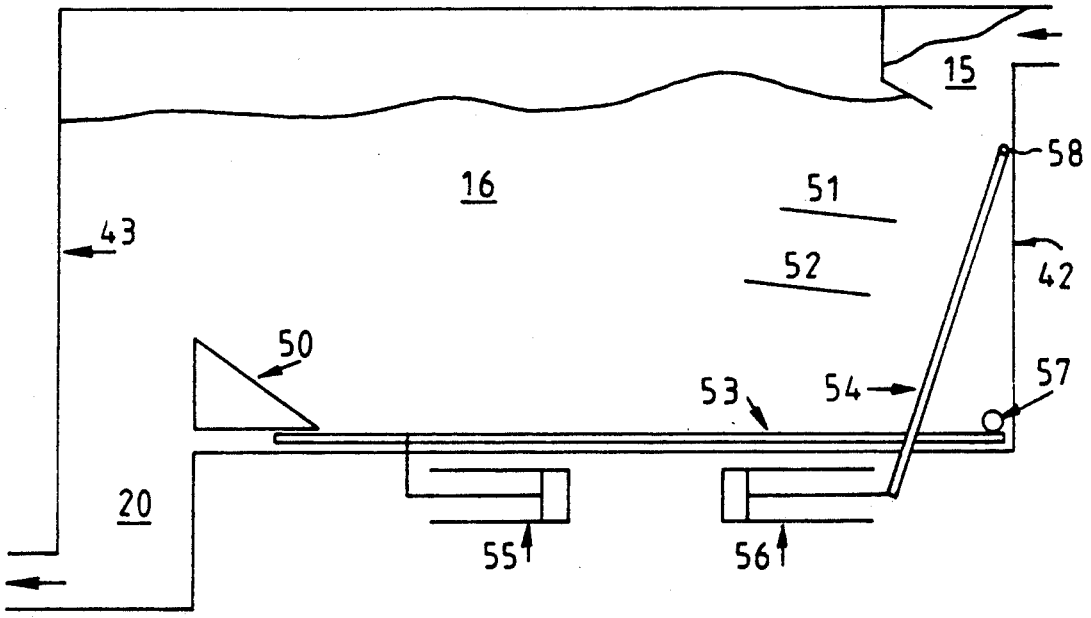

ARTICLE CONVEYING DEVICE

This invention concerns an article conveying device and is particularly concerned with conveying articles in bulk from one location to another. The invention is particularly concerned with conveying articles through a chamber in a substantially continuous manner such that the articles move from an inlet to an outlet and spend some time within the chamber in the process of moving from one to the other.

The chamber could be a hopper acting as a "buffer" between, say, a manufacturing unit feeding the inlet to the chamber and a further processing unit at the outlet chamber, the chamber accepting any excess or deficiency in supply compared with demand of the two devices and thus acting as a buffer or storage hopper for the system.

Alternatively the chamber could, for example, be a curing chamber in which articles dwell as they pass from the inlet to the outlet the time taken for a particular article to pass from one to the other being at least that sufficient for the article to a "cure" in this process. This application is particularly useful in the manufacture of cigarette filter rods in which the rod making machine is to be connected to a cigarette making machine and between the rod making machine and a device for feeding the cigarette making machine the filter rods need to be cured by a period of time during which they dwell before being passed to the cigarette making machine. A particular application of the present invention is to provide a chamber in which that dwell time is provided.

Devices have been proposed for delaying the passage of cigarette filter rods from a rod making machine to a cigarette making machine in a curing chamber but in previously proposed devices the articles are conveyed on conveyors which carry the articles from the inlet to the outlet end of the chamber. Typically the articles, perhaps six or seven deep, will be stacked on a conveyor and conveyed through a chamber dropping onto successive conveyors in a zig zag path as the filter rods pass from the top of the bottom of the chamber. In an alternative proposal the rods may be conveyed individually or again in a stack perhaps six deep on a spiral conveyor progressing from the top to the bottom of the chamber.

By the present invention it is proposed to avoid the use of such expensive and complex conveyor mechanisms within the chamber. It is an object of the present invention to provide a curing chamber in which no such complex conveyors are provided, but in which cigarette filter rods are conveyed from one end to the other with the typical transfer time being sufficiently long to allow the filter rods to cure. It is proposed that the transfer should be effected without complex conveying devices but with simple plates to urge the filter rods in bulk from one end of the chamber to the other in an oscillating movement during each movement of which some filter rods are fed through the outlet permitting further rods to enter through the inlet thereby maintaining the chamber in a substantially filled condition. Thus, the filter rods are conveyed in an intermittent manner but have a regular level resulting in a substantially continuous feed through the curing chamber.

The invention as herein described is not limited to the conveying of cigarette filter rods but is applicable to any rod-like article and particularly those which may be somewhat resilient and therefore subject to compression not allowing transfer by simple pressure against the end of a stack of such articles which may result in undesirable crushing of the articles.

Although described with reference to a curing chamber for filter rods, the invention is equally applicable to any conveying device and is useful wherever articles are to be moved from one location to another using a simple mechanism.

According to the present invention, there is provided a conveying device for coveying articles within a chamber from an inlet end of the chamber to an opposed outlet end of the chamber, said conveying device comprising a base support upon which the articles rest and a side support inclined relative to the base support and against which the articles rest, the base support and side support each being moveable relative to the opposed ends of the chamber and being moveable relative one to the other and means for moving the base support and side support together in the direction from the inlet end to the outlet end to move articles in that direction, and for moving the base support and side support separately in the direction from the outlet end to the inlet end to cause relative movement between the supports, and create a void in the area defined between the supports adjacent the inlet end to receive articles entering the chamber through the inlet.

Preferably, the inclination of the side support relative to the base support is variable.

Preferably, the side support is pivotally mounted to move relative to the base support and vary its inclination thereto.

Preferably, the means for moving the base and side supports is adapted to (i) move the base support and side support together from the inlet end to the outlet end with the side support pivoting relative to the base support to vary the inclination therebetween, (ii) move the base support relative to the side support from the outlet to the inlet end, move the side support from the outlet to the inlet end, (iii) pivot the side support relative to the base support.

In a preferred embodiment of the base support is disposed substantially horizontally and is constrained to move substantially horizontally, the side support is mounted on a pivot disposed above the base support, is disposed substantially at right angles to the base support, and moveable between a first location at which it is disposed adjacent the inlet end wall of the chamber and a second location in which it is inclined thereto. The side support may be pivoted below the inlet to the chamber whereby articles can fall from the inlet into the voids created between the base and side supports as the device operates.

The device may include an obstruction means for restraining or restricting the movement of the articles from the outlet and towards the inlet end.

The obstruction means may comprise a vane disposed within the chamber and inclined to the direction of movement of the supports from the inlet end to the outlet, and wherein the vane presents no obstruction to movement in that direction but restricts movement in the reverse direction.

The device may include a series of such vanes disposed within the chamber and defining a divergent channel with the base support in the direction from the inlet to the outlet end.

The device may also include an inclined surface against which the articles are impelled by movement of the supports, the articles moving up said inclined surface in moving from the inlet end to the outlet end.

The inclined surface may be located adjacent the outlet. The outlet may be disposed in the base of the container with the inclined surface terminating above the exit to permit articles to fall therethrough.

The invention will now be described with reference to the accompanying drawings in which:

FIG. 3(*ii*) is a diagrammatic section through the conveying device showing the base support and side support moved to a discharge position.

FIG. 3(*iii*) is a diagrammatic section through the conveying device showing the base support moved to the inlet and FIG. 3(*iv*) is a diagrammatic section through the conveying device showing both the base support and side support returned to the initial position shown in FIG. 3(*i*).

Figure 1:
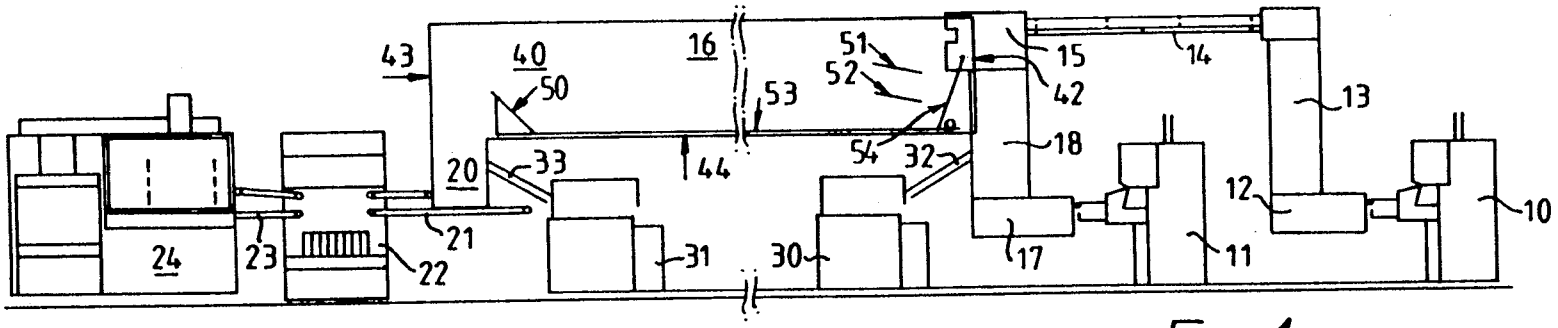
FIG. 1 is a diagrammatic elevation of a production line for cigarette filter rods including a conveying device according to the present invention.
Figure 2:
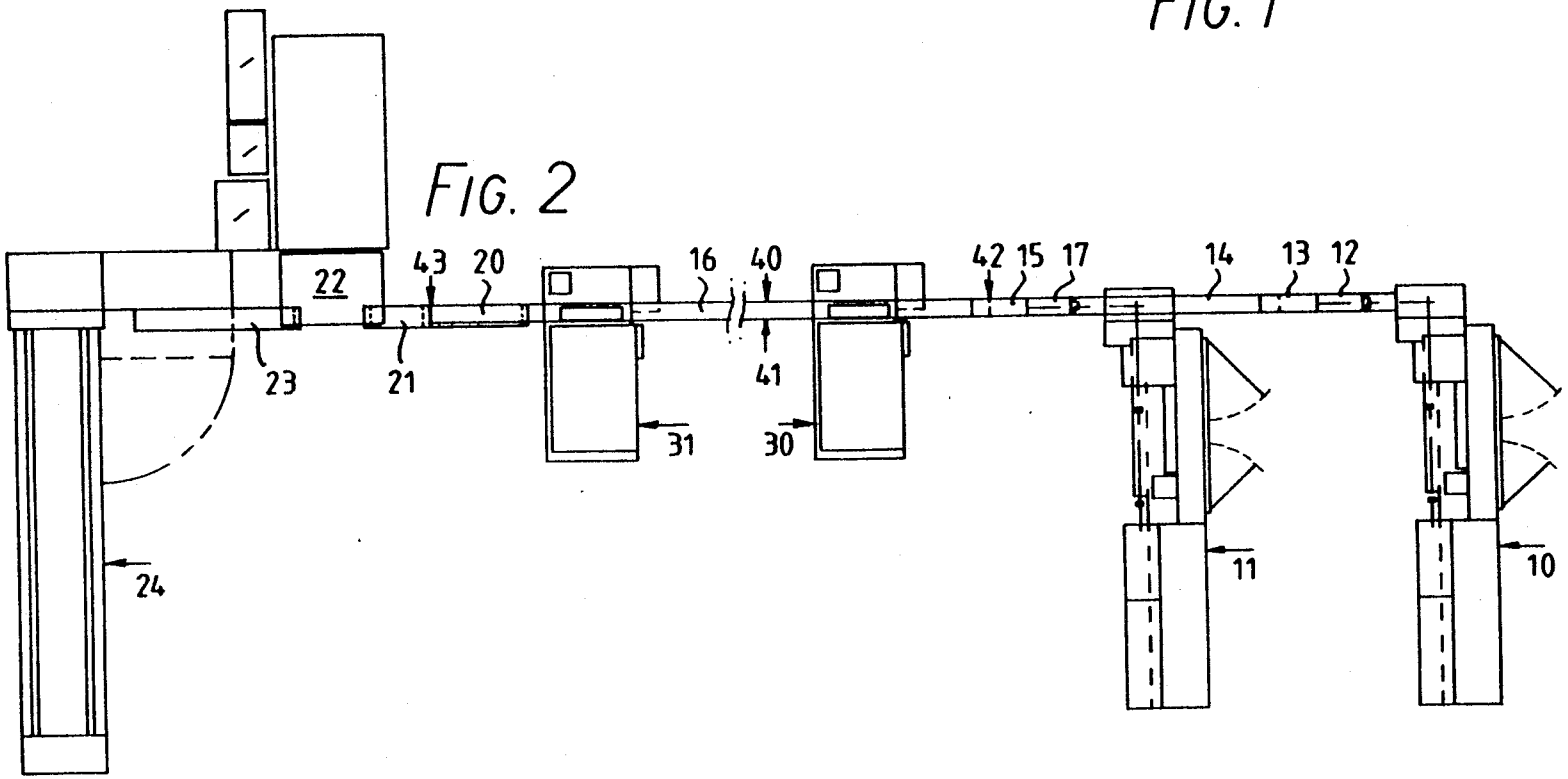
FIG. 2 is a plan view of the structure shown in FIG. 1.

Referring to FIG. 1, there is shown an assembly line for the production of cigarette filter rods comprising cigarette filter rod makers 10 and 11 of known design such, for example, as those made by the Hauni company under their reference KDF2.

The output from the rod maker 10, namely a series of cigarette filter rods in multiples of four or six unit lengths, are conveyed by known conveyor means 12 by a vertical conveyor 13 and by a further horizontal conveyor 14 to the inlet 15 of a curing chamber 16.

The output from rod maker 11 passes to a horizontal conveyor 17 through a vertical conveyor 18 to the inlet 15. Thus, the output from both rod makers 10 and 11 is fed to the inlet 15 to the chamber 16.

At the end of the chamber 16 opposed to the inlet 15 is an outlet 20 from which cigarette filter rods which have passed through the chamber 16 are deposited onto a conveyor 21 and fed into a shooter 22 such as the "Filtromat" shooter made by the Hauni company which device is adapted to collate the cigarette filter rods and convey them by pneumatic means to a cigarette making machine (not shown) at which they are used in the manufacture of cigarettes.

Also feeding the device 22 is a conveyor 23 from a box unloader 24 the purpose of which is to automatically unload boxes of cigarette filter rods packed onto the box unloader and to convey these unloaded cigarette filter rods by means of the conveyor 23 into the device 22 again to be conveyed to the cigarette making machine by a pneumatic conveyor (not shown).

Disposed below the chamber 16 are vertical tray fillers 30 and 31 of known design and construction. The tray fillers 30 and 31 are designed to receive cigarette filter rods and to pack these rods into boxes or trays for storage purposes. Those trays or boxes can be used to feed the box unloader 24.

The tray filler 30 is fed by a conveyor 32 which cooperates with the vertical conveyor 18 by means (not shown) such that cigarette filter rods passing on the vertical conveyor 18 can be deflected from the inlet 15 to the conveyor 32 rather than fed into the chamber 16.

The tray filler 31 is fed by a conveyor 33 which cooperates with the outlet 20 in an arrangement (not shown) by which cigarette filter rods can be deflected from the outlet 20 to the conveyor 33. Again cigarette filter rods entering the tray filler 31 will be filled into trays or boxes for storage. These trays or boxes can be fed to the box unloader 24 to be fed to the shooter 22.

In use, the cigarette filter rods made on the makers 10 and 11 will be fed via the conveyors 12, 13, 14 and 17, 18 respectively to the inlet 15 to the chamber 16.

The chamber 16 will be operated in a substantially filled condition and will remain so in normal operation with cigarette filter rods passing through the chamber from the inlet 15 to the outlet 20. Cigarette filter rods will enter the chamber 16 via the inlet 15 only when there is room within the chamber to permit the entrance of such rods which will occur when an equivalent amount of rods have left the chamber from the outlet 20. The operation of the chamber 16 will be described in more detail hereafter.

Rods leaving the chamber 20 will be conveyed by the conveyor 21 into the shooter device 22 for transmission to a cigarette rod making machine.

It will be appreciated that the device described above can be operated with either or both of the rod makers 10 and 11 in operation. Furthermore, the chamber 16, which is used to delay the passage of filter rods from the makers 10 and 11 to the shooter 22 to allow those filters to cure in that dwell time, also acts as a buffer for accommodating any variation in the supply of filter rods by the rod makers 10 and 11 compared with the requirement of the shooter 22 for feeding filter rods to the cigarette makers.

Should the rod makers 10 and 11 be producing cigarette filter rods at a rate in excess of that which the shooter can accommodate and thus rods cannot be fed into the chamber 16, these rods can be deflected to the conveyor 32 and used to fill trays or boxes on the tray filler 30. Thus, the rod makers 10 and/or 11 can be operated continuously and need not be shut down if the demand for the rods is less than the output of the rod makers. Any excess capacity can be fed to the tray filler 30 when the chamber 16 is filled and will not accept further filter rods.

Similarly, the contents of the chamber 16 can be deflected to the conveyor 33 to be used to fill the tray filler 31. Thus, the excess capacity of the rod makers 10 and/or 11 if the tray filler 30 is used also to capacity can be taken by the tray filler 31.

The box unloader 24 can be used to feed the production from tray fillers 30 and 31 or the production from any other tray fillers and any other rod makers other than 10 and/or 11. The box unloader 24 can be used to feed cigarette filter rods which are not of the style being made on the rod makers 10 and 11 at any one time if such different designs are need on the cigarette making machine or can of course be used to feed cigarette filter rods to the shooter 22 if for any reason there is no feed available from the outlet 20 of the chamber 16, either because the rod makers 10 and 11 are inoperable or because the conveyors or the chamber 16 are themselves not operable.

It will be appreciated that with the present production layout a very flexible installation is provided by which two rod makers 10 and 11 can be operated at full and efficient capacity to feed a shooter device 22 with appropriate overflow take up in the form of tray fillers 30 and 31 and with alternate capacity supplied by box unloader 24 providing a most useful and flexible installation.

A feature of the present installation which is of particular interest is the chamber 16 which is the delay chamber within which filter rods are permitted to cure in the dwell time taken for the average transfer between inlet 15 and outlet 20.

The chamber 16 is an elongate chamber the opposed side panels 40, 41 which are spaced apart by a distance which is equivalent to the length of a typical cigarette filter rod.

The ends 42, 43 of the chamber with sides 40, 41 define a rectangular chamber in which the inlet 15 is disposed at the upper end of the end panel 42 and the outlet 20 is defined in the base 44 of the chamber adjacent the end panel 43.

Rods entering the inlet 15 would normally be free to fall into the chamber 16, obstructed only by those rods already disposed within the chamber. At the outlet 20 rods are free to fall through that outlet onto the conveyor 21 to be taken away by such conveyor.

Disposed within the chamber 16 is an inclined plate 50 terminating at its upper edge directly over the outlet 20 into which filter rods which are impelled up the ramp 50 fall by gravity onto the conveyor 21.

At the opposed inlet end of chamber 16 there are disposed two vanes 51 and 52 inclined to the base 44 of the chamber 16 such as to define with the base 44 a diverging channel from the inlet 15 towards the outlet 20. The vanes 51 and 52 are disposed between the opposed walls 40 and 41 of the chamber 16 and are fixed thereto. The vanes 51 and 52 are parallel with one another but disposed at an angle to the base 44.

Disposed within and forming a false base to the chamber 16 is a base support plate 53. The support plate 53 covers the whole of the base of chamber 16 and substantially fills the space between opposed side walls 40 and 41 but is somewhat shorter than the distance between the end wall 42 and the outlet 20. The plate 53 passes below the inclined surface 50 and is adapted to move horizontally to oscillate between two positions in one of which it is disposed adajcent end wall 42 and the other of which is spaced from end wall 42 but in both positions the distant end of the plate 53 is always disposed below the inclined plate 50 such that there is never a gap between the plates 50 and 53. Pivotaly mounted adjacent end wall 42 and immediately below the inlet 15, is an end plate 54 which can pivot between locations in which it is spaced from and inclined to the end wall 42 and a position in which it is disposed parallel and adjacent to the end wall 42.

Operation of the chamber 16 and the manner in which movement of articles is effected within the chamber is described by reference to FIG. 3.

Figure 3I:
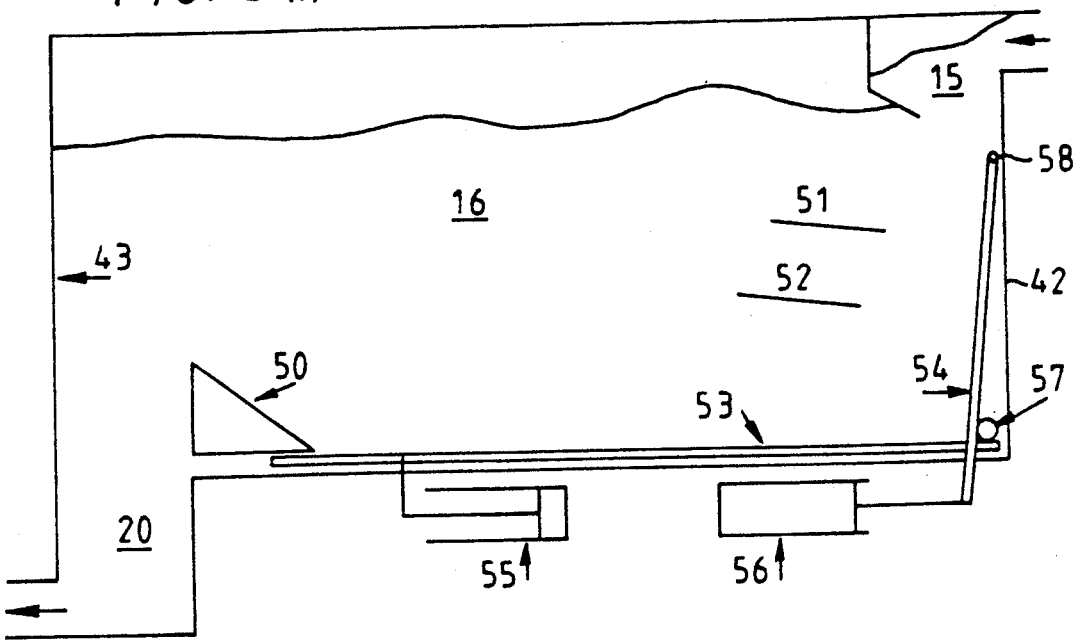
FIG. 3(*i*) is a diagrammatic section through the conveying device showing the device in its initial position.
Figure 3:
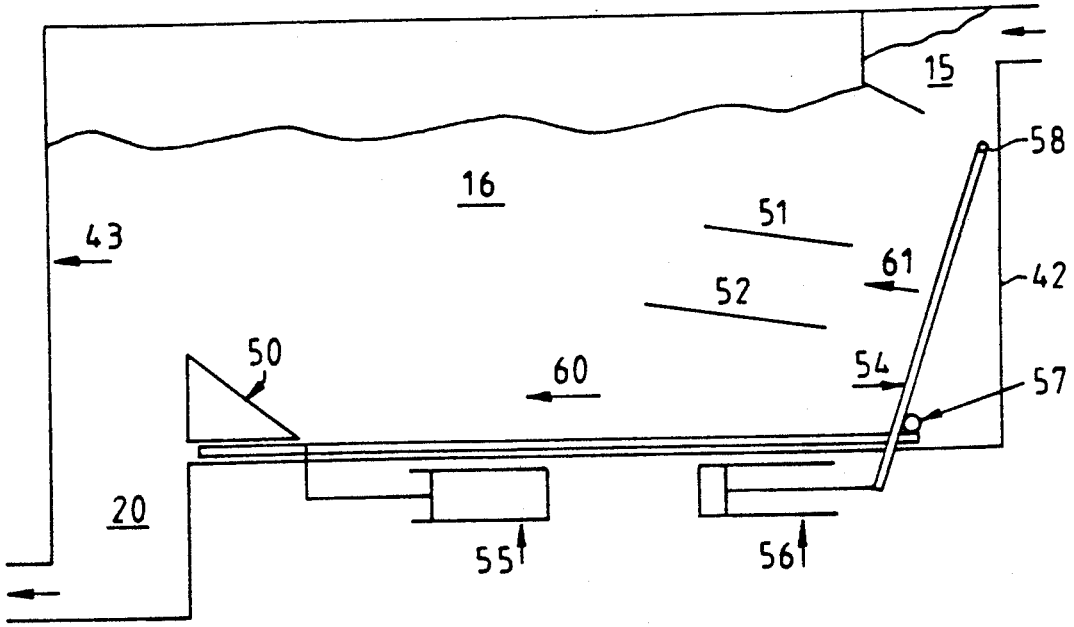
Figure 3:
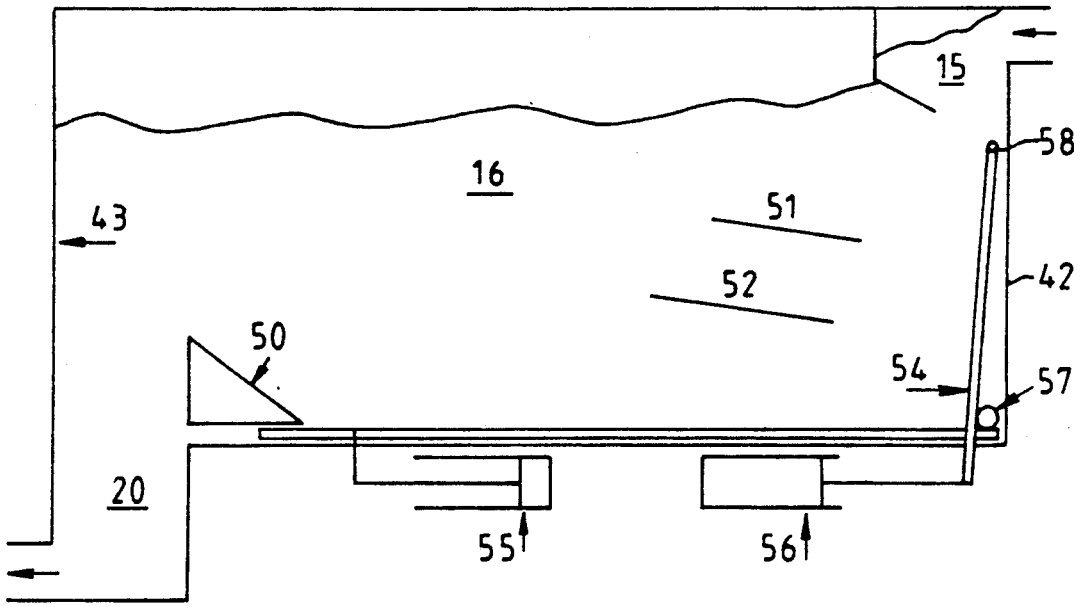

Referring to FIG. 3, there is shown diagrammatically in view (i) the base support plate 53 disposed horizontally and at right angles to the pivotal end support plate 54. Pneumatic rams 55 and 56 are shown diagrammatically connected to the plates 53 and 54 respectively to effect movement of these plates.

The plate 53 is adpated to be moved by the ram 55 from the location shown in views (i), (iii) and (iv) in which it is at the extreme right hand end of its travel to the location shown in view (ii) at which it is at the extreme left hand range of its travel.

Plate 54 is adapted to move between the location shown in views (i) and (iv) in which it is substantially vertically located at right angles to the plate 53 and parallel to the end wall 42 of the chamber 16 and the location shown in views (ii) and (iii) at which the plate 54 has pivoted about pivot 58 to the position in which it is inclined to the end wall 42 and is inclined at an obtuse angle to the plate 53.

Connected to the plate 53 is a roller 57 which bears against the plate 54 as the plate 53 is moved to the left from the position shown in view (i) to the position shown in view (ii) to cause the plate 54 to move with the plate 53 upon operation of the ram 55. During such movement the ram 56 is free and the plate 54 is free to pivot on pivot point 58.

The operation of the conveying device is as follows. From the initial condition shown in view (i) with the plate 53 parallel to the base of the container 16 and with the plate 54 in a vertical position adjacent the end wall 42, the container 16 is substantially filled with cigarette filter rods.

Operation of the pneumatic ram 55 to cause the ram to move to the left will cause the plate 53 to move to the left and the roller 57 bearing against the plate 54 will cause that plate to pivot on pivot point 58 to move that plate to the left. Thus, plates 53 and 54 will move from the position shown in view (i) to the position shown in view (ii). Since the whole of the chamber 16 is filled with cigarette filter rods which rest upon the plate 53 and bear against the side plate 54, the whole of the mass of the rods within the chamber will move in the direction of arrows 60 and 61, that is from the inlet 15 towards the outlet 20. Since both plates 53 and 54 move simultaneously, the whole of the mass of cigarette filter rods contained within the chamber will be moved bodily in this direction.

During the movement in the direction of arrows 60 and 61 those rods adjacent the inclined plate 50 will moved up this plate and will move into the exit 20. Filter rods will move downwardly within exit 20 as the lowermost rods are conveyed away by conveyor 21.

The pneumatic ram 55 is now operated to move the plate 53 to the right and simultaneously the pneumatic ram 56 is operated to hold the plate 54 to its left hand position shown in views (ii) and (iii). Thus, the relative position shown in view (iii) will prevail with the plate 53 having returned to its right hand location and the plate 54 remaining inclined to the end wall 42 and to the plate 53.

In the final stage of operation, the ram 56 is operated to return the plate 54 to its extreme right hand location parallel to the end wall 42 as shown in view (iv). In moving from the position shown in view (iii) to the position shown in view (iv), a void will be created in the swept volume created by movement of the plate 54 and into this void will fall those filter rods located immediately adjacent the plate 54. With the movement of filter rods into that void, a space will be created adjacent the uppermost end of the plate 54, that is adjacent the inlet 15, and such space will permit further filter rods to be fed into the chamber 16 through the inlet 15.

The cycle is then repeated by evacuating the pneumatic ram 56 and starting again from the position shown in view (i).

Through each cycle the mass of cigarette filter rods will be moved bodily to the left, i.e. from inlet 15 towards outlet 20, and then on the return cycle the rods will be rearranged within the stack to fill the void created by plate 54 sweeping back to its rest location and by that rearrangement space will be created adjacent the top of the filled chamber 16 adjacent inlet 15 to allow further filter rods to feed into the chamber by an amount equivalent to those dispensed through the outlet 20 during each cycle.

It has been found that the effectiveness of the operation of the plates 53 and 54 in moving the mass of cigarette filter rods within the chamber can be improved by the addition of means for restricting or preventing the rearward movement of filter rods on the return movement of plate 53. The means for achieving this restriction is provided in this embodiment by vanes 51 and 52 in such a way as to form a diverging passage defined with the plate 53, the passage diverging from the inlet 15 towards the outlet 20.

In operation as the plates 53 and 54 move between the location shown in views (i) and (ii), the body of filter rods will move to the left past vanes 51 and 52 which, in defining a diverging passage with plate 53, offer no resistance to movement of the rods. On the return movement between the position shown in view (ii) to the position shown in view (iii) as the plate 53 returns, the tendency of cigarette filter rods resting upon the plate 53 to return in the direction of the arrow 70 will be restricted by impact upon the plates 51 and 52. As the cigarette filter rods meet these plates, the movement will tend to direct the cigarette filter rods towards plate 53 in a constricting movement since they define with the plate a converging passage in the direction from outlet 20 to inlet 15 and thus the additional pressure so created will limit the movement of the cigarette filter rods, permitting the plate 53 to travel below those rods without taking the rods with it. Thus the plate 53 can return to its position shown in view (iii) leaving the mass of filter rods in the position adopted with the plate 53 at its extreme left hand position.

The inclined ramp 50 also serves to provide a resistance to movement of cigarette filter rods in the direction from the inlet 15 to the outlet 20 but not such as to prevent such movement. Rather, the ramp 50 provides some resistance and permits the rods to travel up the ramp and into the outlet 20. The ramp provides a benefit, since in the absence of the ramp the rods when filling the chamber and outlet 20 will present a substantially solid wall for the movement of the rods as the rods adjacent the outlet 20 impact against the wall 43. Without the ramp 50 to deflect the rods in a direction away from direct impact on end wall 43, the efficiency of the device is found to be substantially less.

In place of the inclined ramp 50, there could of course be further vanes similar to vanes 51 and 52 disposed in similar locations in addition to or in place of the ramp 50. Such vanes would again deflect the rods in an upward manner preventing direct impact on the wall 43.

It will be appreciated that other means may be provided for limiting or restricting the movement of the rods in opposed directions, the vanes 51 and 52 being only one means for so achieving this restriction or constraint.

It will also be appreciated that the plates 53 and 54 need not be moved simultaneously in the manner described using roller 57. Rather, the plate 53 and 54 could be quite independently operated using rams 55 and 56, although the movement could be simultaneous to achieve the movement shown between views (i) and (ii) and independent thereafter.

Similarly, the plates 53 and 54 need not be parallel and closely adjacent the base and end walls respectively of the chamber 16. Furthermore, the plates 53 and 54 need not be at right angles to one another in the rest position. The plate 54 need not be pivoted in the manner shown and other relative movement between members 53 and 54 could be used.

Although described with reference to the movement of cylindrical cigarette filter rods, it will be appreciated that the conveying device could be used for conveying any articles.

The conveyor described above is particularly inexpensive but efficient, avoiding the need for complex conveyor belt systems and yet achieving a dwell time within a buffer, hopper or delay chamber either to cure the content or to act as a buffer between production units. Thus, the device could be used for solid rods or articles.

Although the invention is particularly applicable to cylindrical items, it is not so restricted. The device employing plates 53 and 54 which span the chamber 16 and effectively form false base and end plates for the chamber could be used for moving, say, spherical or other shaped en mass through the chamber.

I claim:

1. A conveying device for conveying articles within a chamber from an inlet end of the chamber to an opposed outlet end of the chamber, said conveying device comprising a base support upon which the articles rest, a side support inclined relative to the base support and against which the articles rest, the base support and side support each being moveable relative to the opposed ends of the chamber and being moveable relative one to the other, and means for moving the base support and side support together in the direction from the inlet end to the outlet end to move articles in that direction, and for moving the base support upon which in use the articles rest and side support separately in the direction from the outlet end to the inlet end to cause relative movement between the supports, so that the base support reaches its inlet end position before the side support reaches its inlet end position so as to create a void in an area defined between the supports adjacent the inlet end to receive articles entering the chamber through the inlet.

2. A conveying device as claimed in claim 1 wherein the inclination of the side support relative to the base support is variable.

3. A conveying device as claimed in claim 2 wherein the side support is pivotally mounted to move relative to the base support and vary its inclination thereto.

4. A conveying device as claimed in claim 1 wherein the means for moving the base and side supports is adapted to (i) move the base support and side support together from the inlet end to the outlet end with the side support pivoting relative to the base support to vary the inclination therebetween, (ii) move the base support relative to the side support from the inlet to the outlet end, (iii) pivot the side support relative to the base support.

5. A conveying device as claimed in claim 4 wherein the base support is disposed substantially horizontally and is constrained to move substantially horizontally, the side support is mounted on a pivot disposed above the base support and disposed substantially at right angles to the base support and moveable between a first location at which it is disposed adjacent the inlet end of the chamber and a second location in which it is inclined thereto.

6. A conveying device as claimed in claim 5 wherein the side support is pivoted below the inlet to the chamber whereby articles can fall from the inlet into the voids created between the base and side support plates as the device operates.

7. A conveying device as claimed in claim 1 including obstruction means for restricting movement of the articles from the outlet end towards the inlet end.

8. A conveying device as claimed in claim 7 wherein said obstruction means comprises a vane disposed within the chamber and inclined to the direction of movement of the supports from the inlet end to the outlet end and wherein the vane prevents no obstruction to movement in that direction but restricts movement in the reverse direction.

9. A conveying device as claimed in claim 8 wherein there is a series of vanes disposed within the chamber defining a divergent channel with the base support in the direction from the inlet end to the outlet end.

10. A conveying device as claimed in claim 1 wherein there is provided an inclined surface against which the articles are impelled by movement of the supports, the articles moving up said inclined surface in moving from the inlet end to the outlet end.

11. A conveying device as claimed in claim 10 wherein the inclined surface is located adjacent the outlet.

12. A conveying device as claimed in claim 11 wherein the outlet is disposed in the base of the container, the inclined surface terminating above the outlet to permit articles to fall therethrough.

13. A conveying device as claimed in claim 1 wherein the side support remains stationary during movement of the base support towards the inlet end after the base support has reached its inlet end position.

* * * * *